US011033797B2

(12) United States Patent
Simpson

(10) Patent No.: US 11,033,797 B2
(45) Date of Patent: Jun. 15, 2021

(54) FOOTBALL HELMET HAVING IMPROVED IMPACT ABSORPTION

(71) Applicant: Safer Sports, LLC, Carlsbad, CA (US)

(72) Inventor: Elwood J. B. Simpson, Brownsburg, IN (US)

(73) Assignee: Safer Sports, LLC, Carlsbad, CA (US)

( * ) Notice: Subject to any disclaimer, the term of this patent is extended or adjusted under 35 U.S.C. 154(b) by 190 days.

(21) Appl. No.: 16/232,844

(22) Filed: Dec. 26, 2018

(65) Prior Publication Data

US 2019/0126127 A1 May 2, 2019

Related U.S. Application Data

(60) Continuation of application No. 15/397,941, filed on Jan. 4, 2017, now Pat. No. 10,201,743, which is a division of application No. 13/645,968, filed on Oct. 5, 2012.

(51) Int. Cl.

| | |
|---|---|
| ***A63B 71/10*** | (2006.01) |
| ***A42B 3/12*** | (2006.01) |
| ***A42B 3/06*** | (2006.01) |
| ***A42B 3/08*** | (2006.01) |
| ***A42B 3/20*** | (2006.01) |

(52) U.S. Cl.

CPC ..... *A63B 71/10* (2013.01); *A42B 3/063* (2013.01); *A42B 3/08* (2013.01); *A42B 3/12* (2013.01); *A42B 3/125* (2013.01); *A42B 3/127* (2013.01); *A42B 3/128* (2013.01); *A42B 3/20* (2013.01)

(58) Field of Classification Search

CPC ..... A42B 3/06; A42B 3/063; A42B 3/064; A42B 3/10; A42B 3/12; A42B 3/125; A42B 3/127; A42B 3/128; A42B 3/145; A42B 3/08; A42B 3/20; A63B 71/10

See application file for complete search history.

(56) References Cited

U.S. PATENT DOCUMENTS

| | | | |
|---|---|---|---|
| 3,116,490 | A | 1/1964 | Zbikowski |
| 3,186,004 | A | 6/1965 | Carlini |
| 3,465,363 | A | 9/1969 | Raney |
| 3,720,955 | A | 3/1973 | Rawlings |
| 3,849,801 | A | 11/1974 | Holt et al. |
| 3,906,546 | A | 9/1975 | Gooding |
| 3,935,044 | A | 1/1976 | Daly |
| 3,992,721 | A | 11/1976 | Morton |
| 4,016,734 | A | 4/1977 | Morton |
| 4,020,507 | A | 5/1977 | Morton |
| 4,023,213 | A | 5/1977 | Rovani |

(Continued)

FOREIGN PATENT DOCUMENTS

| | | |
|---|---|---|
| NL | 2005798 | 6/2012 |

*Primary Examiner* — Khaled Annis

(74) *Attorney, Agent, or Firm* — Stetina Brunda Garred and Brucker

(57) ABSTRACT

A football helmet is disclosed that includes a shell constructed of fiber reinforced epoxy resin, a liner made from expanded polypropylene, an impact absorbing layer situated between the liner and the shell, and a face guard. The impact absorbing layer is constructed from either expanded polypropylene or a viscoelastic polymer encased in a suitable thin yet resilient and elastic membrane. An optional impact absorbing band is also shown disposed around the inner periphery of the liner and encircling the player's head. The impact absorbing band serves to reduce impact forces occurring from side helmet impact with objects or players.

14 Claims, 11 Drawing Sheets

(56) References Cited

U.S. PATENT DOCUMENTS

| | | | |
|---|---|---|---|
| 4,044,399 | A | 8/1977 | Morton |
| 4,101,983 | A | 7/1978 | Dera et al. |
| 4,404,690 | A | 9/1983 | Farquharson |
| 4,912,778 | A | 4/1990 | Daniels |
| 4,937,888 | A | 7/1990 | Straus |
| 4,996,724 | A | 3/1991 | Dextrase |
| 5,093,936 | A | 3/1992 | Copeland et al. |
| 5,150,479 | A | 9/1992 | Oleson |
| 5,271,103 | A | 12/1993 | Darnell |
| 5,272,773 | A | 12/1993 | Kamata |
| 5,448,780 | A | 9/1995 | Gath |
| 5,450,631 | A | 9/1995 | Egger |
| 5,915,537 | A | 6/1999 | Dallas et al. |
| 5,940,889 | A | 8/1999 | Shirai |
| 6,032,297 | A | 3/2000 | Barthold et al. |
| 6,154,889 | A | 12/2000 | Moore et al. |
| 6,219,850 | B1 | 4/2001 | Halstead et al. |
| 6,604,246 | B1 | 8/2003 | Obreja |
| 7,328,462 | B1 | 2/2008 | Straus |
| 7,676,854 | B2 | 3/2010 | Berger et al. |
| 7,841,025 | B1 | 11/2010 | Fink et al. |
| 8,347,419 | B1 | 1/2013 | Cleva |
| 8,615,817 | B2 | 12/2013 | Phillips |
| 8,640,267 | B1 | 2/2014 | Cohen |
| 8,782,819 | B1 | 7/2014 | Culpepper |
| 9,572,390 | B1 | 2/2017 | Simpson |
| 9,603,408 | B2 | 3/2017 | Simpson |
| 10,201,743 | B1 | 2/2019 | Simpson |
| 2001/0011388 | A1 | 8/2001 | Nelson et al. |
| 2002/0068152 | A1 | 6/2002 | Heath et al. |
| 2002/0120978 | A1 | 9/2002 | Moore |
| 2004/0025231 | A1 | 2/2004 | Ide et al. |
| 2005/0278834 | A1 | 12/2005 | Lee |
| 2006/0123526 | A1 | 6/2006 | Lim |
| 2007/0000032 | A1 | 1/2007 | Morgan |
| 2010/0000009 | A1 | 1/2010 | Morgan |
| 2010/0171349 | A1 | 7/2010 | Dellano |
| 2010/0180363 | A1 | 7/2010 | Glogowski |
| 2010/0258988 | A1 | 10/2010 | Darnell et al. |
| 2011/0061154 | A1 | 3/2011 | Turner et al. |
| 2011/0277226 | A1 | 11/2011 | Turner |
| 2011/0296594 | A1 | 12/2011 | Thomas et al. |
| 2012/0005810 | A1 | 1/2012 | Cheng |
| 2012/0017358 | A1 | 1/2012 | Princip et al. |
| 2012/0036620 | A1 | 2/2012 | Harris |
| 2012/0047635 | A1 | 3/2012 | Finiel et al. |
| 2012/0052249 | A1 | 3/2012 | Turner |
| 2012/0060251 | A1 | 3/2012 | Schimpf |
| 2012/0261327 | A1 | 8/2012 | Turner |
| 2012/0233745 | A1 | 9/2012 | Veazle |
| 2013/0061375 | A1 | 3/2013 | Bologna et al. |
| 2013/0340146 | A1 | 12/2013 | Dekker et al. |
| 2014/0020158 | A1 | 1/2014 | Parsons et al. |

FOOTBALL HELMET HAVING IMPROVED IMPACT ABSORPTION

RELATED APPLICATIONS

This application is a continuation of U.S. application Ser. No. 15/397,941 filed Jan. 4, 2017, which is a divisional of U.S. application Ser. No. 13/645,968 filed Oct. 5, 2012, the entirety of the disclosures of which are expressly incorporated herein by reference.

FIELD OF THE INVENTION

This invention relates in general to protective head gear and more specifically to football helmets.

BACKGROUND OF THE INVENTION

Helmets have long been worn in the sport of football to protect a player's head from injury resulting from impact with other players, ground impact, or impact with objects on or off the field. Recent prior art helmets typically include an outer shell made from durable plastic materials, a liner made from a shock absorbing material, a face guard and a chin strap which also functions in some designs as a chin protector. Helmet liners have taken several forms over the years, including encased foam padding, fluid filled jackets or pockets, air inflated bags lining the inner surface of the helmet and other design approaches.

Some recent patents directed to football helmets, such as U.S. Pat. Nos. 7,240,376, 6,934,971 and 7,036,151, all to Ide et al., have focused more on jaw protection, ear protection and improved face guard features without any notable changes in the shock absorbing liner designs. In general though, the overall configuration, design and shape of a football helmet has remained relatively unchanged over an extended period of time.

It is well recognized that no helmet can completely prevent injuries to persons playing the sport of football. The very nature of football is quite physical with much emphasis placed on strength and speed of the players. As players have increased their strength and speed, corresponding improvements in safety equipment, specifically helmets, has not taken place. Shock attenuation and impact force absorption are of foremost importance in the design of a football helmet.

Serious concerns have been raised in recent years regarding concussion injuries suffered by athletes while playing football and the long term affect such brain injuries have on the mental and physical health of those suffering such injuries. Some commentators suggest there may be significant consequences for continuing to play football before recovery from a concussion injury has taken place. Later life cognitive difficulties suffered by former football players are now being associated with concussion injuries received while playing football. Recently, researchers found the players were three times more likely to die from Alzheimer's, Parkinson's or Lou Gehrig's disease than the general population.

Given the recent media coverage of high profile football players who received concussion injuries while playing football and have later in life suffered from maladies and diseases of the brain resulting in abnormal life experiences and behavior, it is abundantly clear that more attention and effort should be directed to protecting players from such injuries.

In view of elevated attention concussion injuries are receiving in the media in relation to football, and in particular the long term negative impact on lives, any new developments in football helmet designs that improve the impact absorption or impact attenuation characteristics of a football helmet and lessen the forces impacting the head of a player are urgently needed.

SUMMARY OF THE INVENTION

A football helmet according to one aspect of the present invention includes a shell having an inner surface, an outer surface, an opening over the face area of the wearer, a crown area and wherein the shell is constructed of fiber reinforced epoxy resin and adapted to receive an athlete's head therein, an energy absorbing layer situated adjacent the inner surface of the shell and extending over the crown area of the shell, a liner having an outer surface conforming with the inner surface of the shell and the energy absorbing layer adjacent the inner surface of the shell and an inner surface closely conforming to the head of the wearer, the liner disposed within the shell such that the energy absorbing layer is situated between the liner and the shell in the crown area of the shell, the liner having a substantially uniform thickness and fabricated from expanded polypropylene, a face mask attached to the shell over the face area of the shell, and wherein the energy absorbing layer has a higher compressive strength than the compressive strength of the liner.

One object of the present invention is to provide an improved football helmet.

Another object of the present invention is to provide a football helmet that is lighter than prior art helmets.

Still another object of the present invention is to provide a football helmet that includes improved impact attenuation and shock absorbing features.

Yet another object of the present invention is to significantly reduce impact forces that are transmitted through a football helmet to the head of the player wearing the helmet.

These and other objects of the present invention will become more apparent from the following description of the preferred embodiments.

DESCRIPTION OF THE PREFERRED EMBODIMENTS

Figure 1:
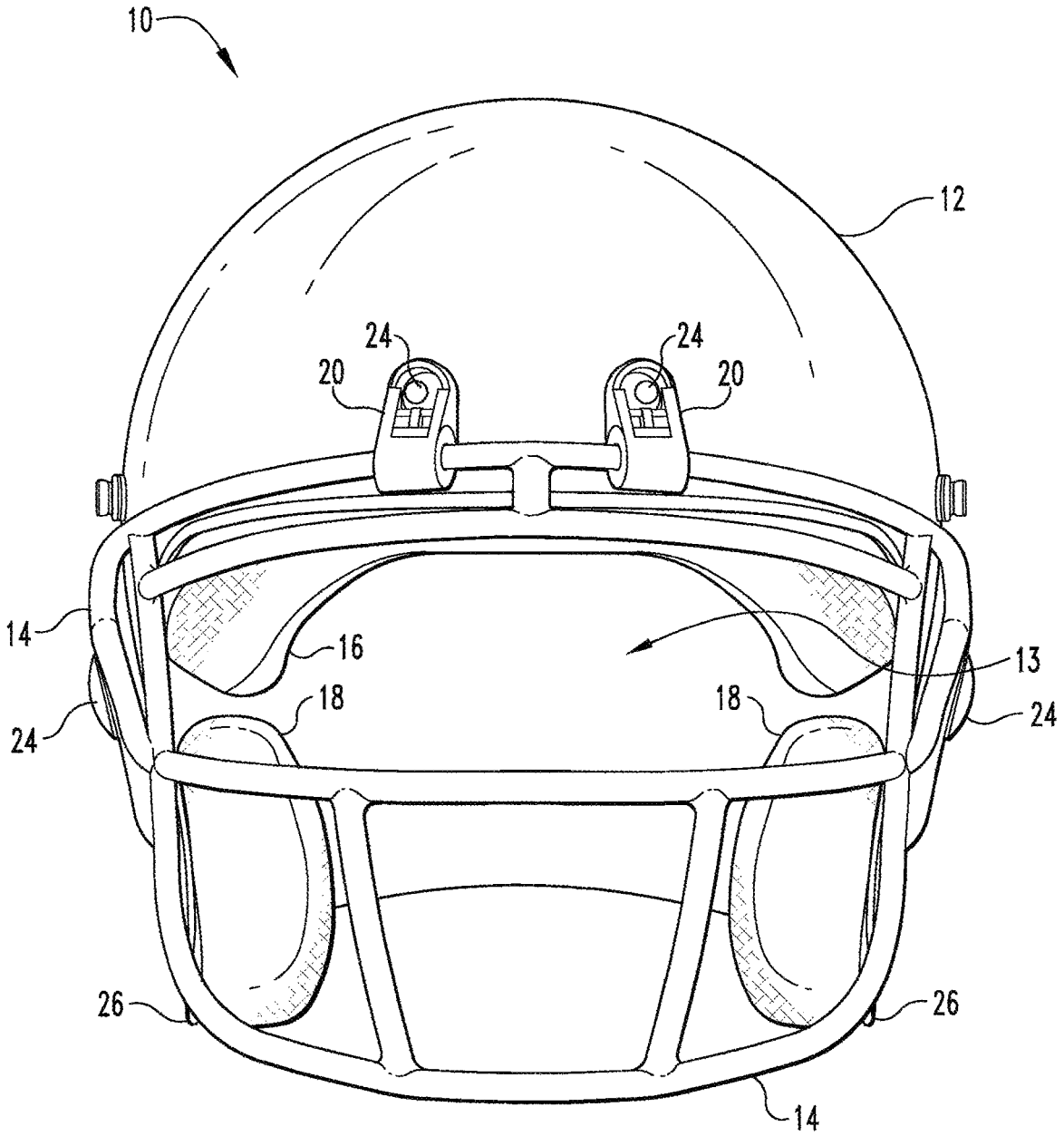
FIG. 1 is a front elevational view of a football helmet according to one aspect of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Figure 2:
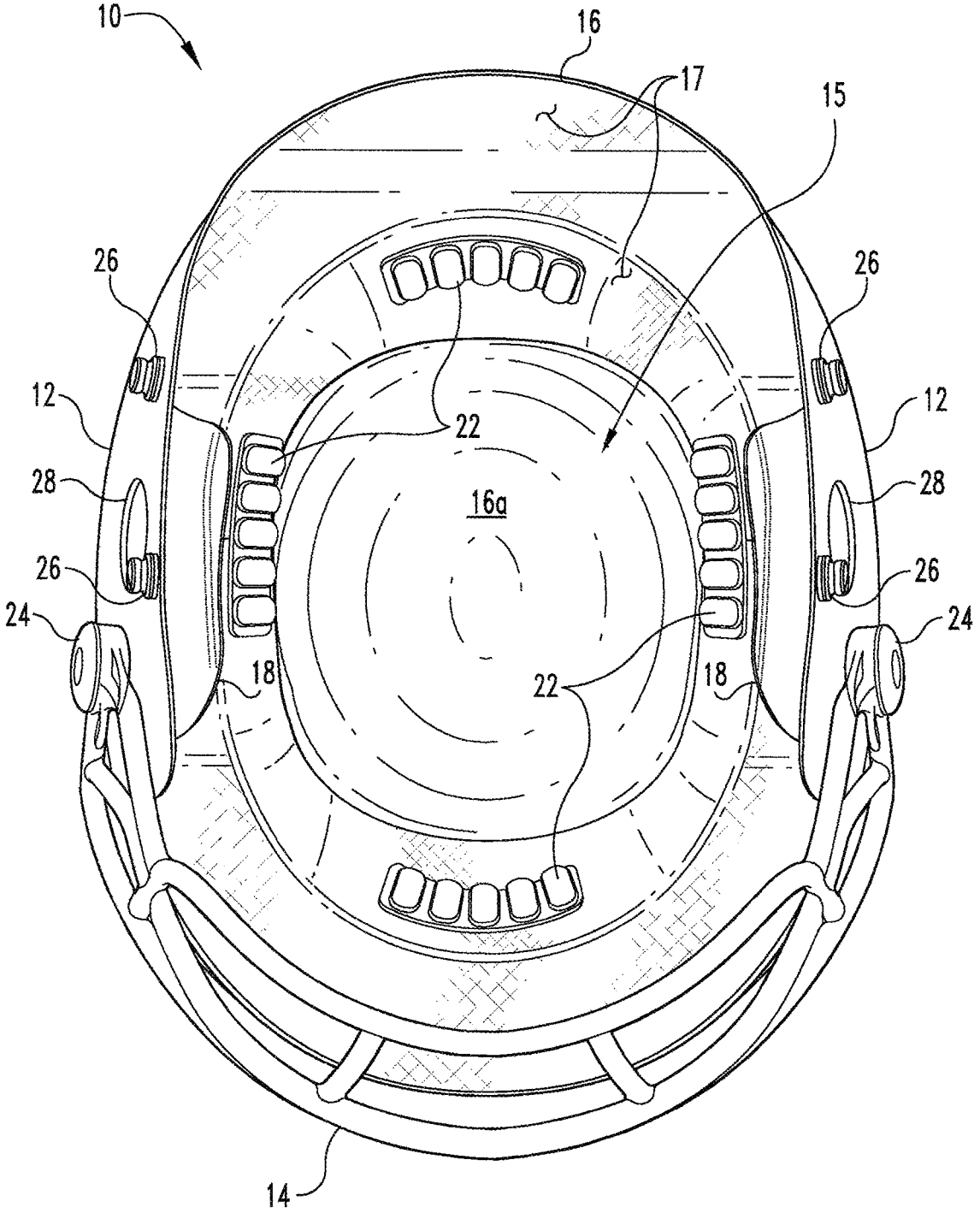
FIG. 2 is a bottom view of the football helmet of FIG. 1.

Referring now to FIGS. 1 and 2, a football helmet 10 according to one aspect of the present invention is shown. FIG. 1 is a front elevational view and FIG. 2 is a bottom view of helmet 10. Helmet 10 includes a shell 12, a face guard or face mask 14, an energy absorbing liner 16, jaw pads 18, and face guard connectors 20. Face guard connectors 20 and screws 24 secure face guard 14 to shell 12. Face guard connectors 20 are secured to shell 12 by screws 24 and nuts (not shown) situated on the inner surface of shell 12. Jaw pads 18 are attached to shell 12 using snap connectors or hook and loop fasteners (not shown). Chin strap snaps 26 are attached to shell 12 by threaded nuts (not shown) situated on the inner surface of shell 12 that engage a threaded portion of snaps 26 which extends through shell 12. Ear apertures 28 in shell 12 are situated over the player's ears and allow sound waves s to readily pass therethrough. Fasteners for attaching face guards, jaw pads and chin straps to football helmets are well known in the art.

Shell 12 is relatively thin (typically less than one-eighth inch or less than 3 mm thick) and constructed of fiber reinforced epoxy resin formed in a shape that is generally conforming with yet larger than a human head. Shell 12 includes a face opening 13 and a head opening 15. Shell 12 is thinner than prior art helmets and weighs substantially less than prior art shells made from polycarbonates or other known plastic materials. Liner 16 is fabricated from expanded polypropylene (EPP) and has an inner surface 16*a* that closely conforms with the general external shape of a human head. The inner surface of liner 16 is covered with a moisture wicking or moisture absorbing cloth material 17 to absorb perspiration from the player's head. The outer surface of liner 16 is shown in more detail in FIG. 3 wherein an energy absorbing layer is also shown in more detail situated between shell 12 and liner 16. Fitment pads 22 are attached to liner 16 about the inner periphery of liner 16 at multiple locations to achieve a comfortably snug fit of helmet 10 on a football player's head. Fitment pads 22 are made from fabric encased resilient foam padding material and are attached using adhesives, book and loop fasteners or the like or other attachment means well known in the art. Fitment pads 22 are available in various thicknesses to accommodate varying head sizes within liner 16. In order to accommodate a large range of head sizes, liner 16 may also be fabricated in a variety of thicknesses and in combination with various sized fitment pads all sizes of human heads are accommodated within helmet 10.

Liner 16 is preferably constructed with external dimensions along the head opening 13 and face opening 15 of shell 12 that are slightly larger than the inner dimensions of shell 12 to create a slight interference fit within shell 12. The process for inserting liner 16 within shell 12 includes slightly compressing liner 16 toward the middle at the edges thereof for installation into shell 12. Liner 16 is retained within shell 12 as a result of the subsequent resilient expansion of liner 16 against the inner surfaces of shell 12. Alternatively, liner 16 may be constructed with external dimensions in the face and head openings to be an exact fit to the inner surfaces of shell 12 and liner 16 is then attached to the inner surfaces of shell 12 using contact adhesive or the like.

Liner 16 is fabricated from expanded polypropylene since it is a highly versatile closed-cell bead foam or foam form of polypropylene that provides a unique range of properties, including outstanding energy absorption, multiple impact resistance, thermal insulation, buoyancy, water and chemical resistance, exceptionally high strength to weight ratio and 100% recyclability. EPP has very good impact characteristics clue to its low stiffness; this allows EPP to resume its shape after impacts. EPP foam possesses superior cushioning properties, is able to absorb kinetic impacts very well without breaking, retains its original shape, and exhibits memory form characteristics which allow it to return to its original shape in a short amount of time. Polypropylene, in general, is not only resilient but also resistant to most solvents and glues.

Figure 3:
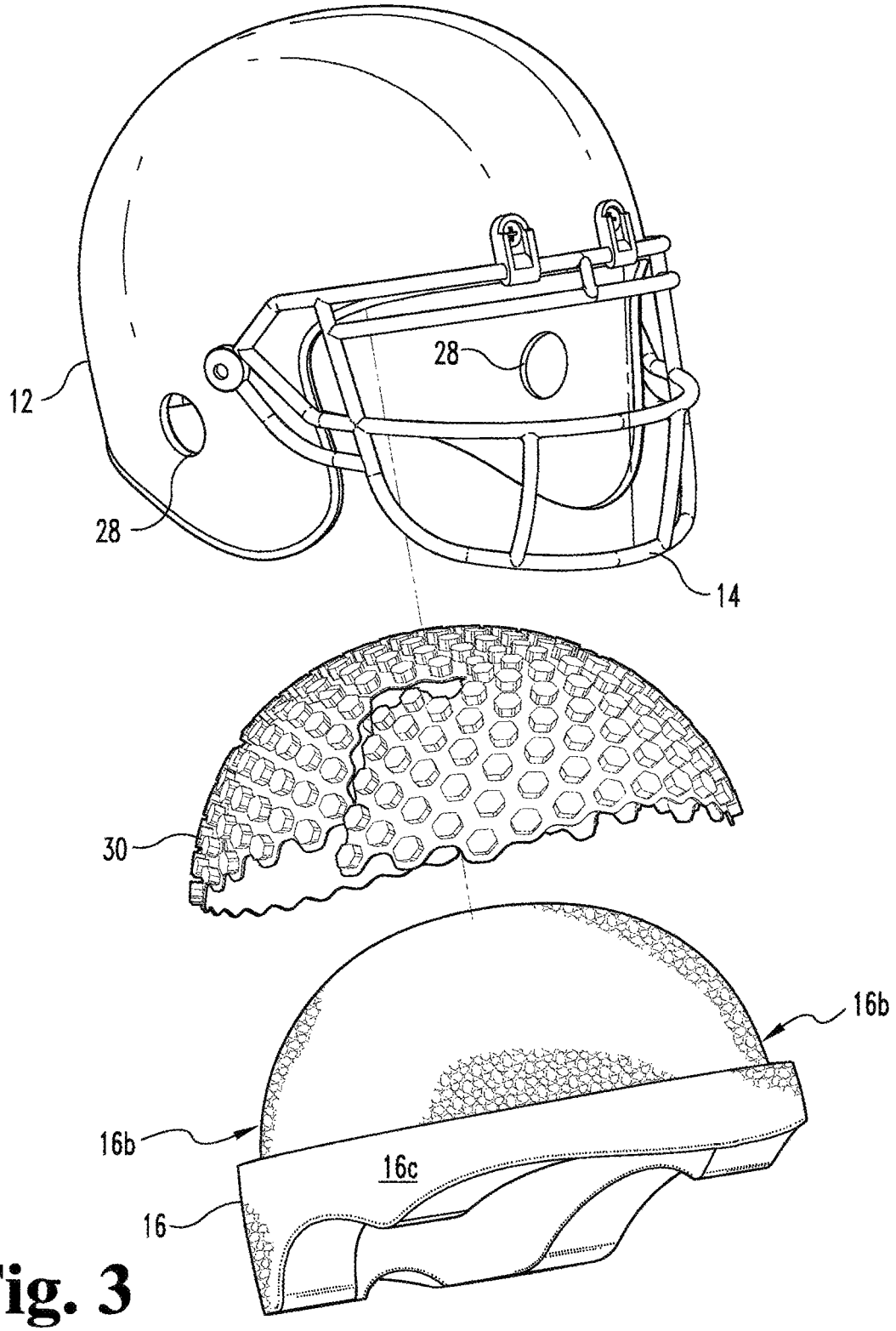
FIG. 3 is an exploded perspective view of the helmet of FIG. 1.
Figure 4:
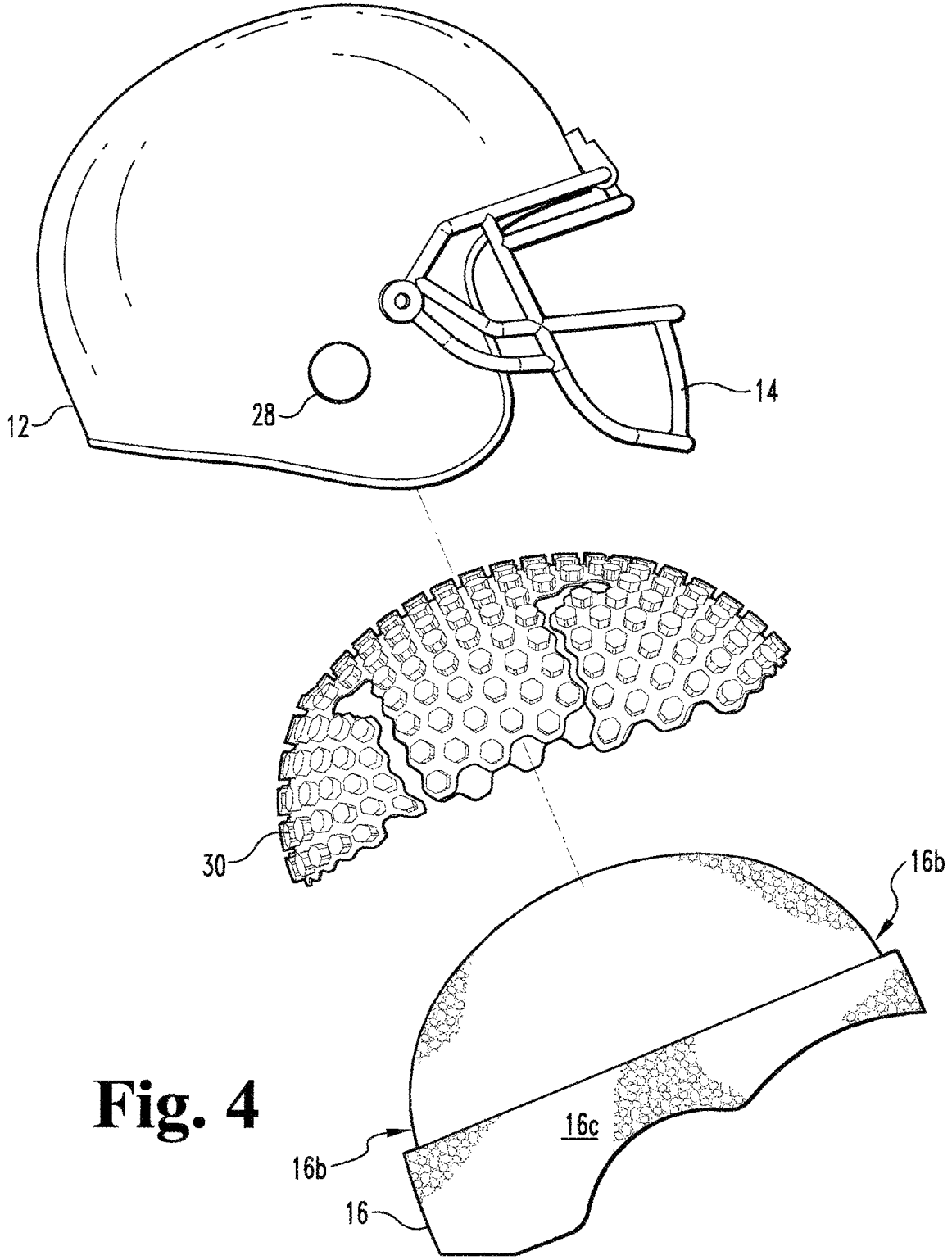
FIG. 4 is an exploded side view of the helmet of FIG. 1.

Referring now to FIGS. 3 and 4, a perspective and side elevational exploded view of helmet 10 are shown, respectively, depicting shell 12, liner 16 and energy absorbing layer 30. During assembly of shell 12 and liner 16, energy absorbing layer 30 is situated in recessed area 16*b* of liner 16. The dimensions of recessed area 16*b* are such that layer 30 is in contact with the recessed external surface area 16*b* and the inner surface of shell 12. Liner 16 is shown in FIGS. 3 and 4 with moisture wicking material 17 removed. Shell 12 is shown with jaw pads 18 removed to more clearly illustrate the assembly process of inserting liner 16 and layer 30 within shell 12. Layer 30 is a resilient membrane with a plurality of energy absorbing nodules suspended therein. The energy absorbing material in layer 30 has a compressive strength greater than the compressive strength or impact attenuation property of the expanded polypropylene of liner 16. Peripheral surface 16*c* of liner 16 is compressed slightly to enable insertion of liner 16 within shell 12. Face guard 14 and ear apertures 28 are also shown in FIGS. 3 and 4.

Figure 5:
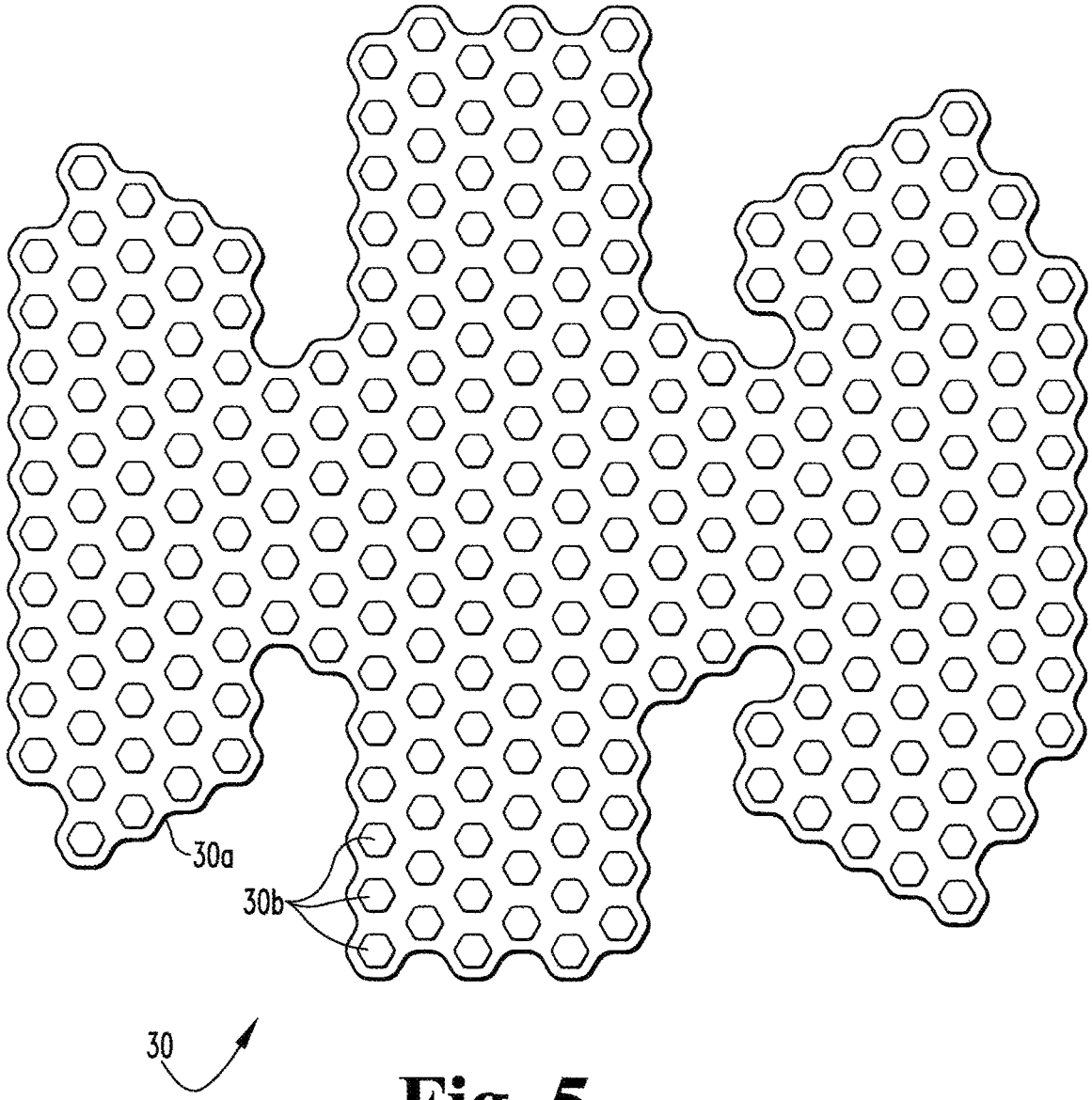
FIG. 5 is a plan view of the energy absorbing layer shown.
Figure 6:
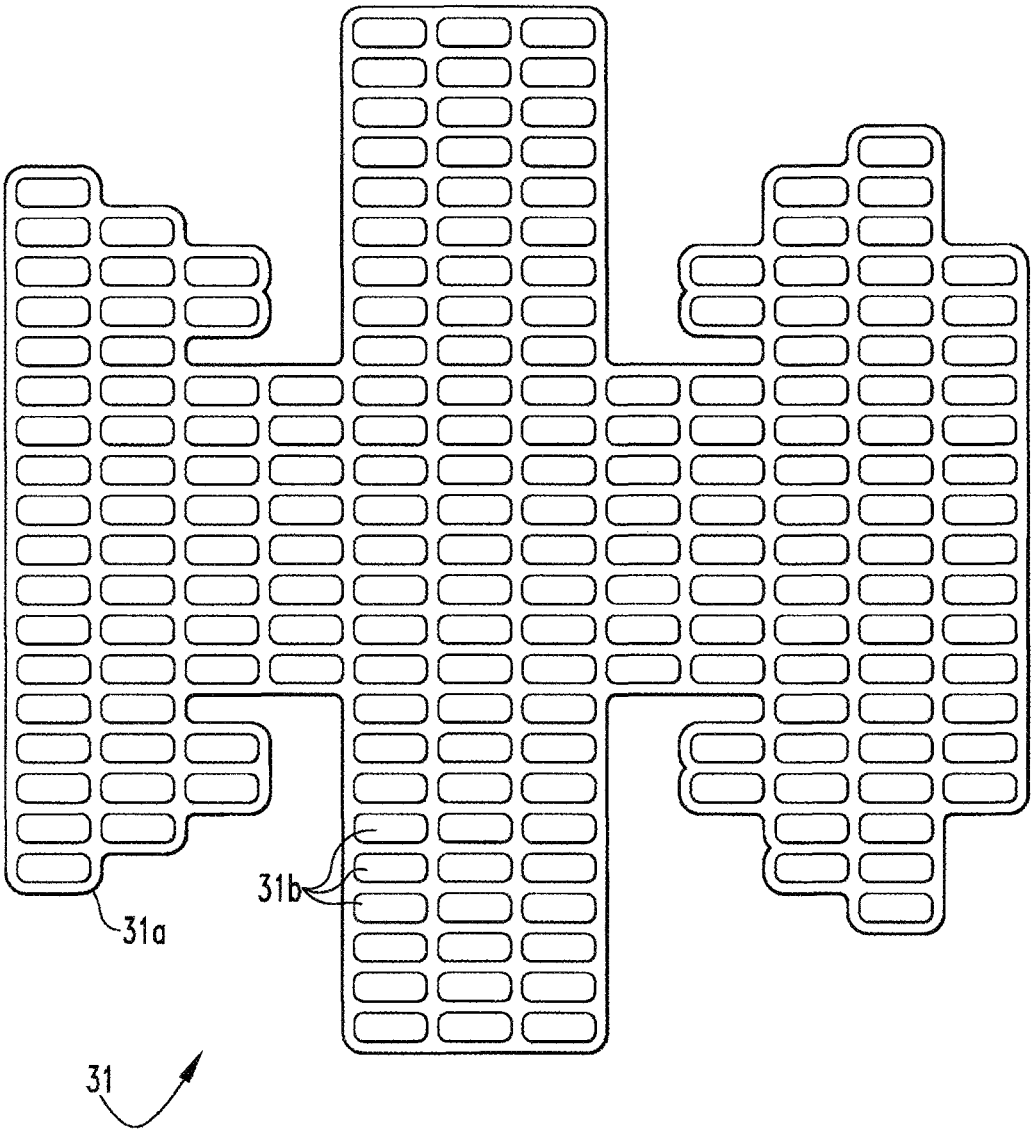
FIG. 6 is a plan view of an alternative energy absorbing layer.

FIGS. 5 and 6 illustrate two different variations for energy absorbing layer 30 presently available, though other geometric arrangements are also contemplated. Energy absorbing layer 30 consists of a flexible resilient membrane 30*a* that encases an array of viscoelastic polymer material 30*b* into pockets within membrane 30*a*. Layer 30 is produced by Impact Innovative Products of 127 Industry Blvd., Irwin, Pa. 15642 and referred to as Zoombang® impact attenuation material by the Impact Innovative Products. FIG. 5 depicts one version of energy absorbing layer 30 having an array of hexagonal pockets of the viscoelastic polymer. FIG. 6 depicts an alternate configuration for energy absorbing layer 31 which includes an array of elongated rounded rectangular pockets 31*b* of the viscoelastic polymer suspended in resilient flexible membrane 31*a*. The precise formulation of the Zoombang® material is presumably a trade secret of Impact Innovative Products. The general geometric configuration of resilient flexible layers 30 and 31 shown in FIGS. 5 and 6, respectively, are intended to be formed to and placed over the pseudo-spherical surface defined by the external surface of recessed portion 16*b* of liner 16 (see FIGS. 3 and 4) such that the entirety of surface 16*b* is well covered and contacted by one side of layer 30 or layer 31. It is also contemplated that a very thin layer of contact adhesive may be used to maintain layer 30 or 31 in position over recessed surface 16*b* when liner 16 and layer 30 are assembled into shell 12.

Figure 8:
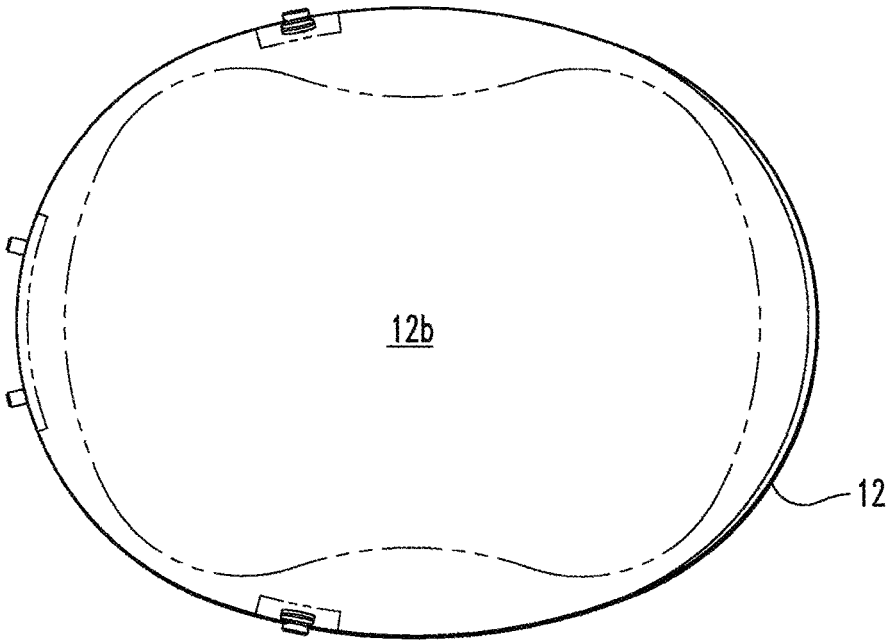
FIG. 8 is a plan view of the helmet shell depicting areas wherein additional reinforcing material are applied.
Figure 7:
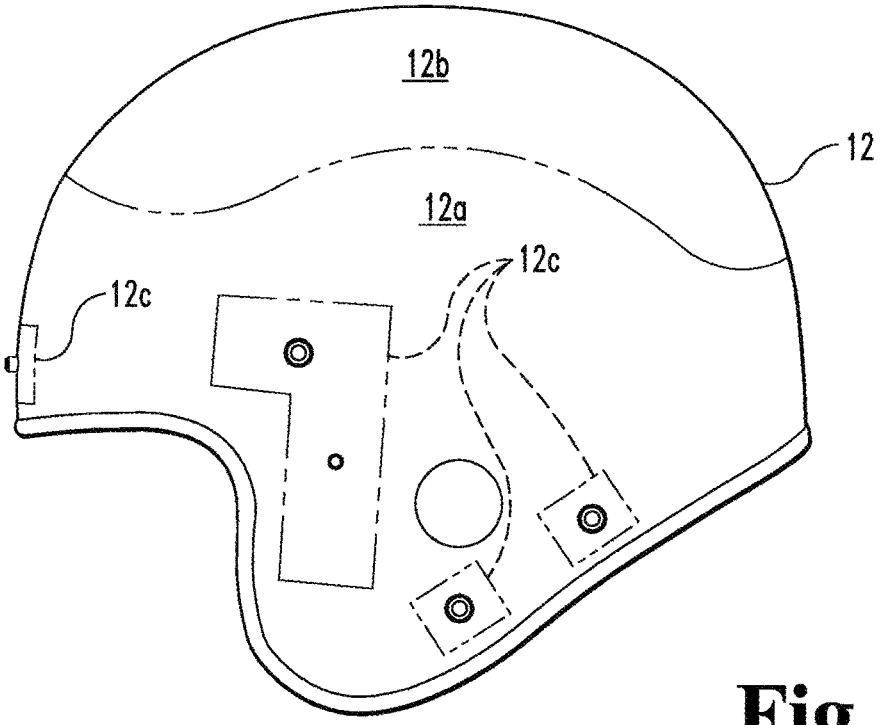
FIG. 7 is a side view of the helmet shell depicting areas wherein additional reinforcing material are applied.

Referring now to FIGS. 7 and 8, a side elevational view and a plan view of shell 12 are shown, respectively, with a number of areas defined by broken lines that depict locations wherein the amount of reinforcing material applied during fabrication of shell 12 will vary. In general, shell 12 includes four (4) layers of reinforcing mesh in area 12*a*, three (3) layers of reinforcing mesh in area 12*b*, and six (6) layers of reinforcing mesh in areas marked 12*c*. The variation in reinforcing material layer count is directly related to the desired strength and amount of resiliency or stiffness desired for the noted regions. In area 12*b* over the brain it is desired that shell 12 have more "resilience" or "flex" upon heavy impact. Area 12*a* may be slightly stiffer in resilience, thus four layers are applied therein. Significant strength is desired in area 12*c* where face guards, jaw pads and chin straps are attached, thus six layers of reinforcing material are applied therein during fabrication of shell 12.

Figure 9:
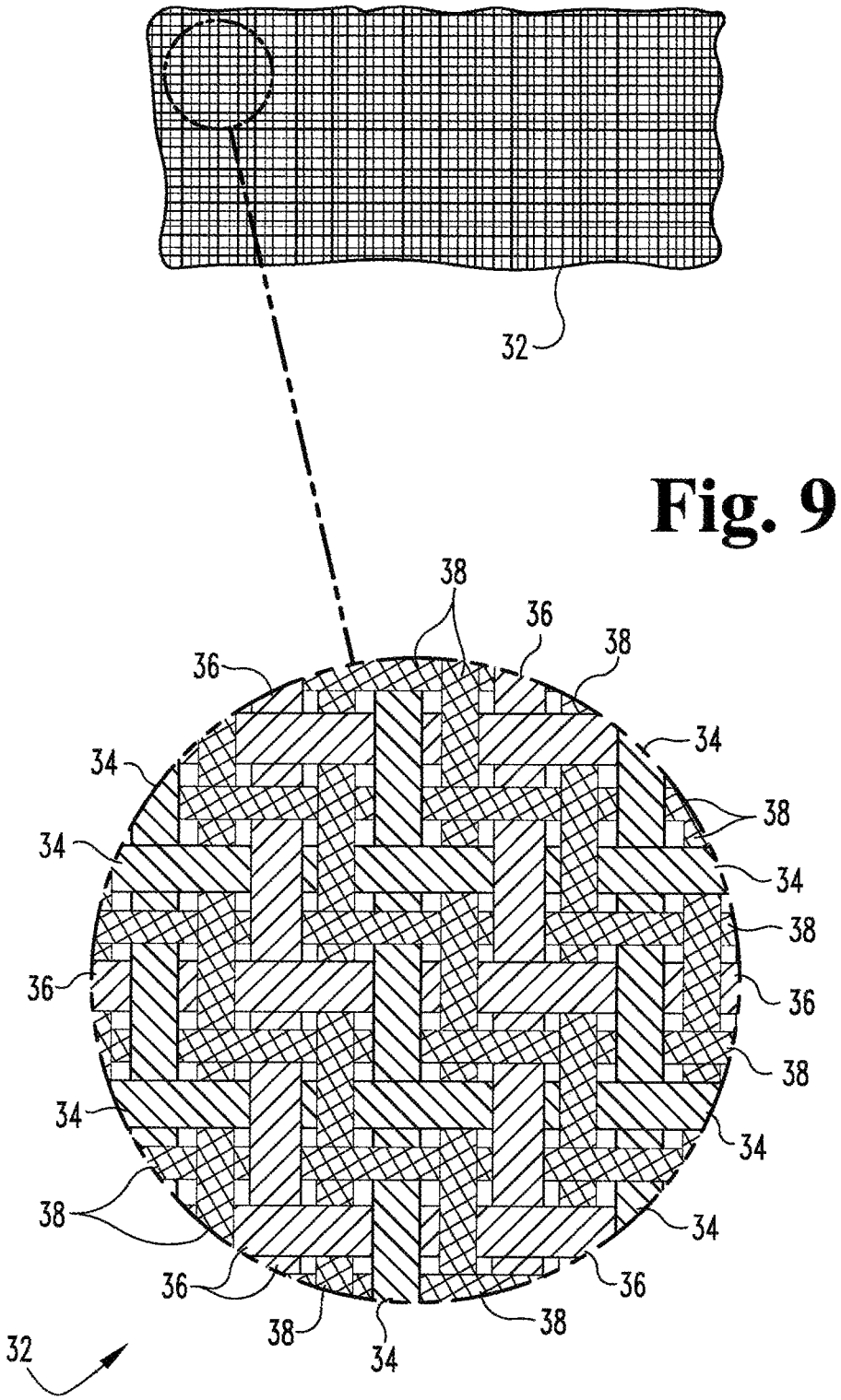
FIG. 9 is a plan view of the reinforcing material used to construct the helmet shell with an enlarged view of the fiber makeup.

Referring now to FIG. 9, a detailed view of the reinforcing mesh 32 encased in epoxy resin to fabricate shell 12 is shown. Mesh 32 includes preferably three different fiber types, namely, carbon fibers, fiberglass fibers and Kevlar® fibers. One combination of fibers that provides desirable strength characteristics along with resiliency and toughness includes a 40 (forty) percent carbon fiber, 40 (forty) percent Kevlar fiber and 20 (twenty) percent fiberglass fiber ratio woven into a mesh as shown in FIG. 9. Kevlar® fiber bundles 34, carbon fiber bundles 36 and fiberglass fiber bundles 38 are cross woven as shown to fabricate mesh 32. The Kevlar® fiber bundles 34 and carbon fiber bundles 36 in mesh 32 are larger in individual fiber count than the fiberglass fiber bundles 38 such that the approximate fiber makeup of 40% Kevlar®$^{fiber}$, 40% carbon fiber and 20% fiberglass fiber content is achieved.

Figure 10:
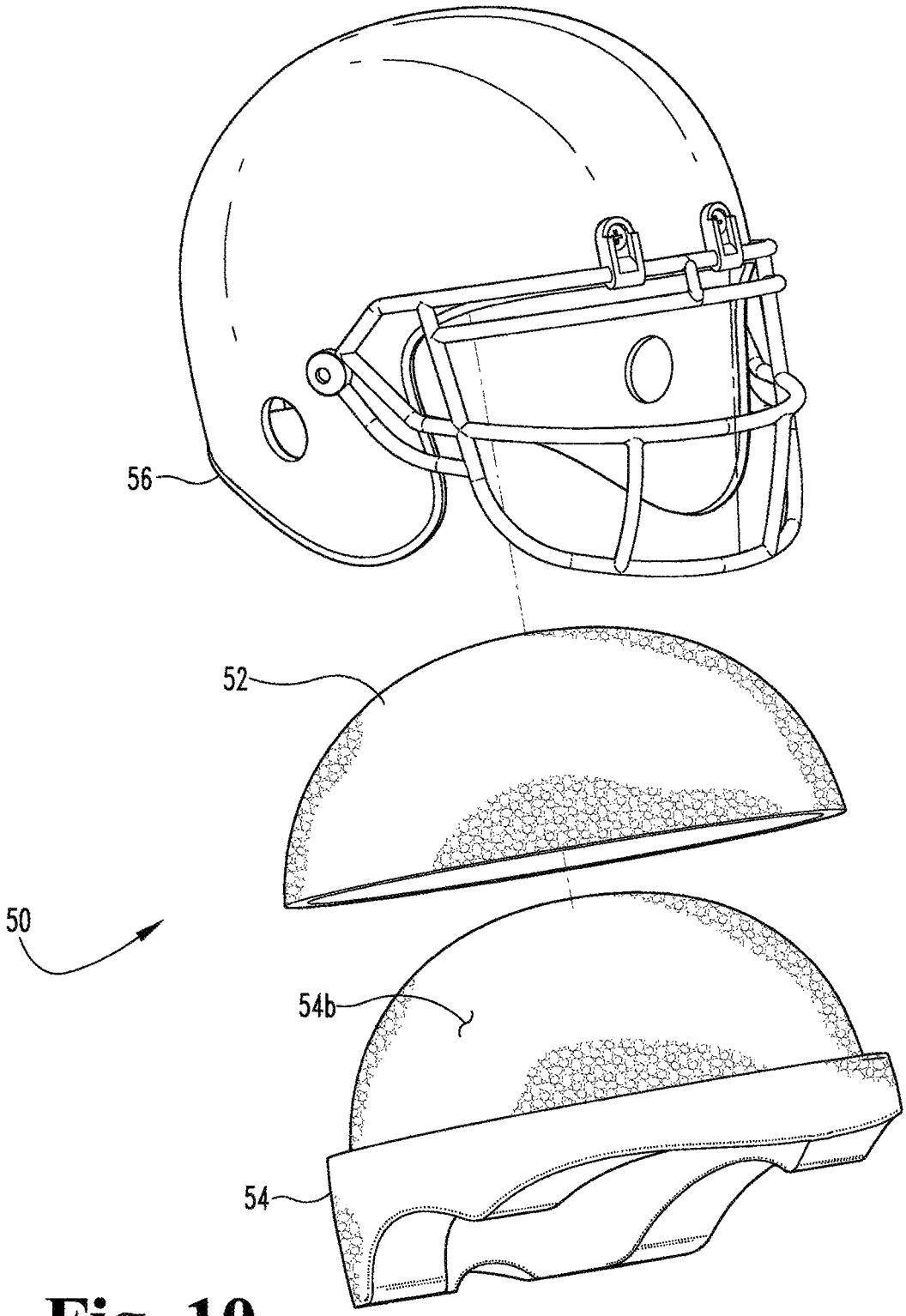
FIG. 10 is an exploded perspective view of another embodiment of a football helmet according to the present invention.

Referring now to FIG. 10, another embodiment of a football helmet 50 according to the present invention is shown in a perspective exploded view. All aspects and components of helmet 50 are identical to those shown for helmet 10 with the exception, of cap 52 which replaces energy absorbing layer 30. Helmet 50 of FIG. 10 is shown without jaw pads for convenience in illustrating the exploded view, but it is contemplated that jaw pads are included with helmet 50. In addition, liner 54 is shown with moisture wicking cloth removed. Cap 52 occupies and completely fills the space between liner 54 and shell 56 when helmet 50 is assembled. The lower surface of cap 52 is formed to coincide precisely with the upper pseudo-spherical recessed surface 54*b* of liner 54 and the external upper surface of cap 52 conforms with the inner surface of shell 56. Thus, cap 52 completely fills the void defined between shell 56 and liner 54. Cap 52 is fabricated from EPP with a higher density than that of the EPP used to fabricate liner 54. Thus, cap 50 has a higher energy absorbing capability or increased impact attenuation as a result of the higher density of the EPP therein. The density of the EPP used to fabricate liner 54 is typically between 2 and 4 pounds per cubic foot and the density for the EPP used in fabricating cap 52 is typically between 4 and 6 pounds per cubic foot, though it is contemplated that other combinations of densities may be desirable to achieve specific impact attenuation results for the combination of liner 54 and cap 52. For example, where players are young and smaller with less speed and strength abilities, lower densities of EPP fore the liner and cap may be more appropriate.

It is foreseeable that liner 54 and cap 52 may be fabricated as a unitary liner by use of sophisticated EPP molding techniques that are presently known or may be developed in the future. If liner 54 and cap 52 are fabricated as a unitary liner then the outer surface of the unitary liner then conforms with the inner surface of shell 56. The unitary liner includes an inner surface closely conforming to the head of the wearer. Further, the unitary liner would include a substantially uniform thickness and be fabricated from expanded polypropylene. The expanded polypropylene at the outer surface of the unitary liner up to a predetermined depth (corresponding with the volumetric area occupied by cap 52) is fabricated from a higher density EPP than the remainder of the liner.

Figure 11:
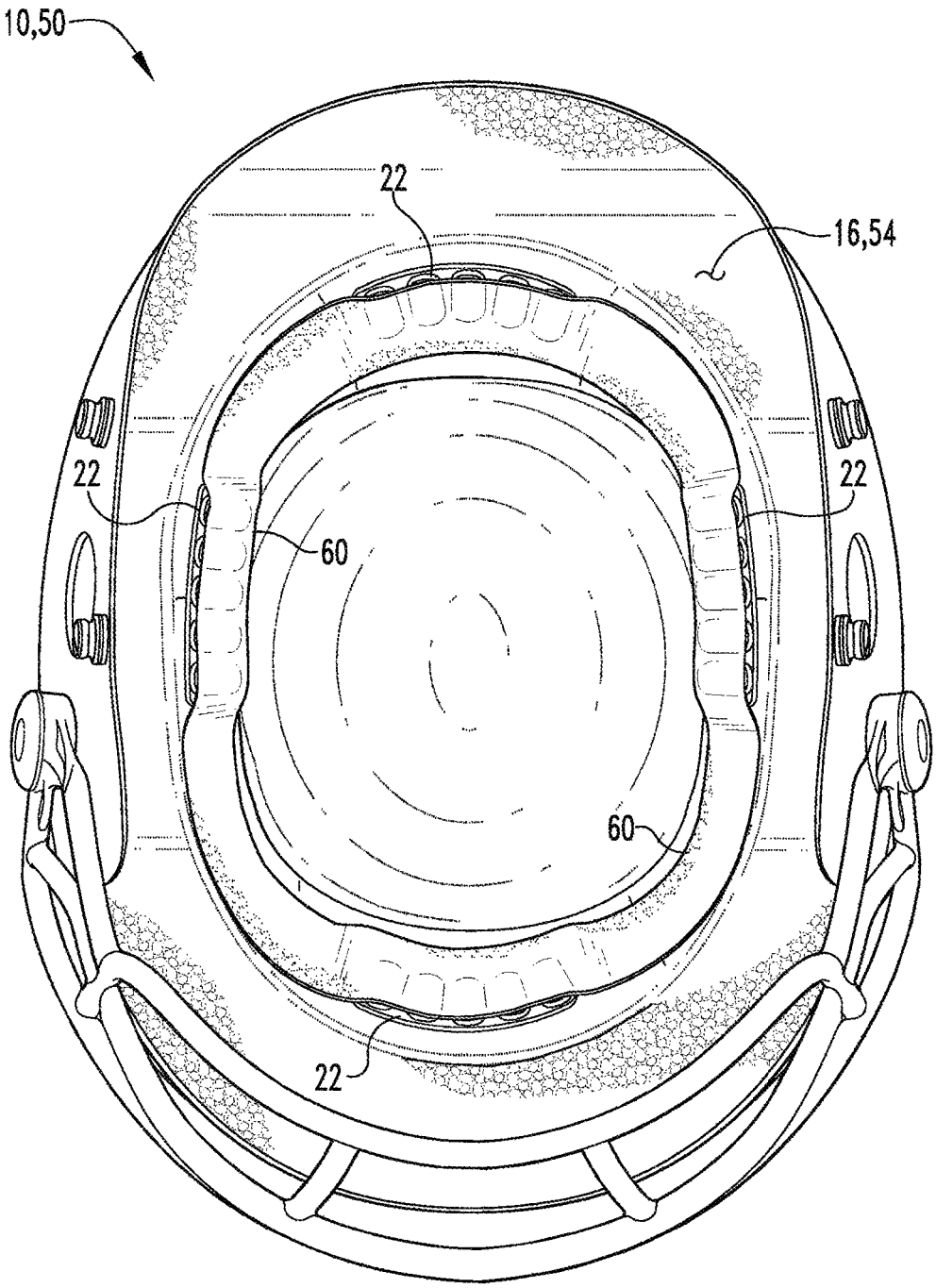
FIG. 11 is a bottom view of another embodiment of a football helmet according to the present invention.
Figure 12:
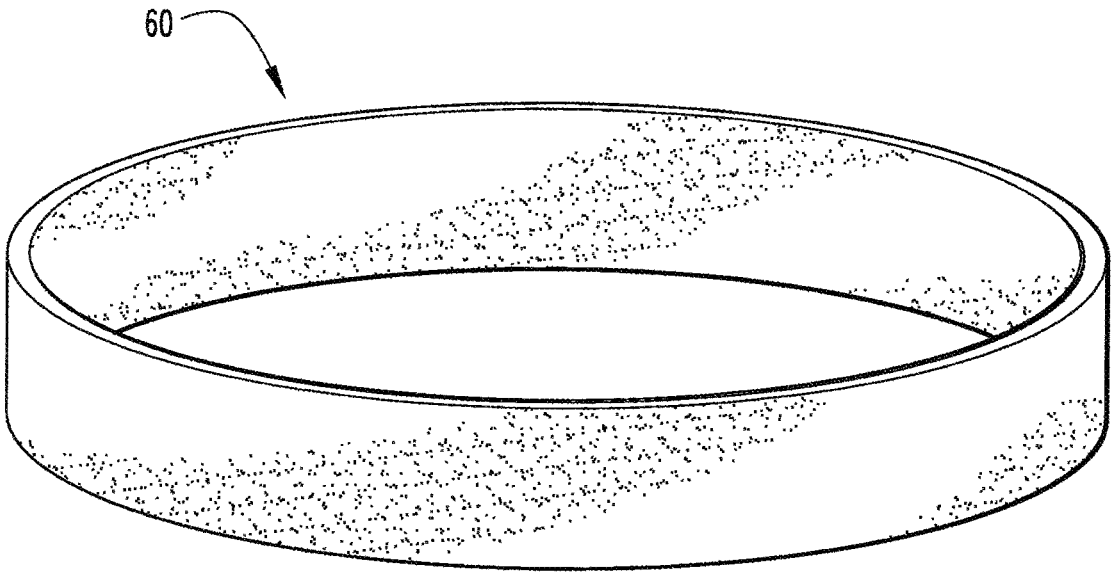
FIG. 12 is a perspective view of the energy absorbing band shown in FIG. 11.

Referring now to FIGS. 11 and 12, another embodiment of a football helmet having an additional impact attenuation feature according to the present invention is shown that is used in conjunction with either helmet 10 or helmet 50. FIG. 11 is a bottom view of either helmet 10 or helmet 50 depicting energy absorbing band 60 installed about the inner periphery of the helmet liner so that the player's head is encircled by band 60. FIG. 12 is a perspective view of energy absorbing band 60. Band 60 is flexible and resilient as it is fabricated from energy absorbing material encased in a thin resilient flexible membrane. Band 60 is situated within the helmet and attached about the inner periphery of the helmet to provide side force impact attenuation for the player's head. Band 60 is disposed over fitment pads 22 and attached to pads 22 and helmet liner 16 or 54. Energy absorbing band 60 is approximately 1 to 2 inches in height and has a higher compressive strength than liners 16 or 54. Band 60 is fabricated from a viscoelastic polymer material such as Zoombang® material, previously discussed, and preferably encased in a moisture absorbing or moisture wicking cloth. Band 60 is attached to liners 16 or 54 and over fitment pads 22 by either adhesives or hook and loop fasteners (not shown), as is well known in the art.

Many different materials are known that have energy absorbing characteristics coupled with resiliency as exhibited by EPP and the substitution of such materials in the present invention is contemplated. Energy absorbing materials such as viscoelastic polymers having compressive strength or impact attenuation properties similar to the Zoombang® material are contemplated as substitutes therefore in the present invention.

While the invention has been illustrated and described in detail in the drawings and foregoing description of the preferred embodiments, the same is to be considered as illustrative and not restrictive in character, it being understood that only the preferred embodiments have been shown and described and that all changes and modifications that come within the spirit of the invention are desired to be protected.

What is claimed is:

1. A football helmet comprising:

a shell having an inner surface, an outer surface, an opening positionable over a face area of a wearer, and a crown area, the shell being constructed of epoxy resin having fiber reinforcement and being adapted to receive a user's head therein; and a liner having an outer surface conforming with the inner surface of the shell, and an inner surface disposable adjacent the head of the wearer, the liner being disposable within the shell, the liner being fabricated from resilient energy absorbing material, the energy absorbing material at the outer surface of the liner up to a predetermined depth having a greater compressive strength than and is unitarily formed with a the remainder of the liner;

wherein the fiber reinforcement in a first region of the shell is lower than the fiber reinforcement in portions of the shell outside of the first region;

wherein the first region is in the crown area of the shell.

2. The football helmet recited in claim 1, wherein the liner includes an inner periphery located about a lower portion of the liner inner surface, the football helmet further comprising a plurality of fitment pads attachable to the inner periphery of the liner for sizing the liner to the head of the wearer.

3. The football helmet recited in claim 1, further comprising a face guard attached to the shell over the face area of the shell.

4. The football helmet recited in claim 1, wherein the inner surface and the outer surface of the liner define a thickness as the distance therebetween, the liner having a substantially uniform thickness.

5. The football helmet recited in claim 1, wherein the inner surface and the outer surface of the shell define a thickness as the distance therebetween, the shell thickness being less than one-eighth of an inch.

6. The football helmet of claim 1 wherein the fiber reinforcement of the shell is a fiber mesh including carbon fibers, Kevlar fibers and fiberglass fibers.

7. The football helmet of claim 1, wherein the liner is fabricated from expanded polypropylene.

8. A football helmet comprising:

a shell having fiber reinforcement, an inner surface, an outer surface, an opening adapted to be over a face area of a wearer, and a crown area, said shell being adapted to receive an athlete's head therein, wherein a strength of the fiber reinforcement in the crown area is lower than a strength of the fiber reinforcement in the areas outside the crown area of said shell; and a liner disposable within said shell and fabricated from a resilient material, the resilient material at the outer surface of said liner up to a predetermined depth having a higher density than a remainder of the liner, wherein the liner has a compressive strength corresponding to the density of the resilient material used to fabricated said liner;

wherein the fiber reinforcement in a first region of the shell is lower than the fiber reinforcement in portions of the shell outside of the first region;

wherein the first region is in the crown area of the shell.

9. The football helmet recited in claim 8, wherein the liner includes an inner periphery located about a lower portion of the liner inner surface, the football helmet further comprising a plurality of fitment pads attachable to the inner periphery of the liner for sizing the liner to the head of the wearer.

10. The football helmet recited in claim 8, further comprising a face guard attached to the shell over the face area of the shell.

11. The football helmet recited in claim 8, wherein the inner surface and the outer surface of the shell define a thickness as the distance therebetween, the shell thickness being less than one-eighth of an inch.

12. The football helmet of claim 8 wherein the fiber reinforcement of the shell is a fiber mesh including carbon fibers, Kevlar fibers and fiberglass fibers.

13. The football helmet of claim 8, wherein the liner is fabricated from expanded polypropylene.

14. The football helmet of claim 8 including an energy absorbing band attached to and situated about the inner periphery of the liner and wherein said energy absorbing band has a higher compressive strength than that of the liner.

* * * * *